United States Patent [19]

Stark et al.

[11] 3,979,048

[45] Sept. 7, 1976

[54] PACKAGE COMPRISING A STIFF STRIP

[75] Inventors: Olof Stark, Rydsgard; Rolf Dilot, Lund, both of Sweden

[73] Assignee: AB Ziristor, Lund, Sweden

[22] Filed: Dec. 4, 1974

[21] Appl. No.: 529,540

[30] Foreign Application Priority Data

Dec. 5, 1973 Sweden ..... 7316394

[52] U.S. Cl. ..... 229/48 T; 229/3.5 R

[51] Int. Cl.[2] ..... B65D 5/42; B65D 3/00

[58] Field of Search ..... 229/48 T, 48 R, 3.1, 229/3.5; 428/57, 61

[56] References Cited

UNITED STATES PATENTS

| | | | |
|---|---|---|---|
| 2,975,955 | 3/1961 | McCurry | 229/48 T |
| 3,147,902 | 9/1964 | Miller | 229/3.1 |

*Primary Examiner*—William Price
*Assistant Examiner*—Douglas B. Farrow
*Attorney, Agent, or Firm*—Pierce, Scheffler & Parker

[57] ABSTRACT

A package having, for example, a parallelepipedic configuration is formed from a tube of laminated packaging material which is obtained by folding a web of the material so that opposite edge portions of the web overlap and form a longitudinally extending joint. The laminated packaging material consists of a base layer of paper or cardboard and facing layers of thermoplastic material, and the cut edge of the material which rests against the inside of the package is prevented from coming into contact with the contents of the package by application of a protective strip thereto along the joint zone, this strip being a laminate consisting of a base layer coated on both sides with a thermoplastic material which is sealed to the inside thermoplastic layer of the package. The base layer of the protective strip has a higher softening temperature than that of the inside thermoplastic layer of the packaging material.

1 Claim, 2 Drawing Figures

PACKAGE COMPRISING A STIFF STRIP

Figure 1:
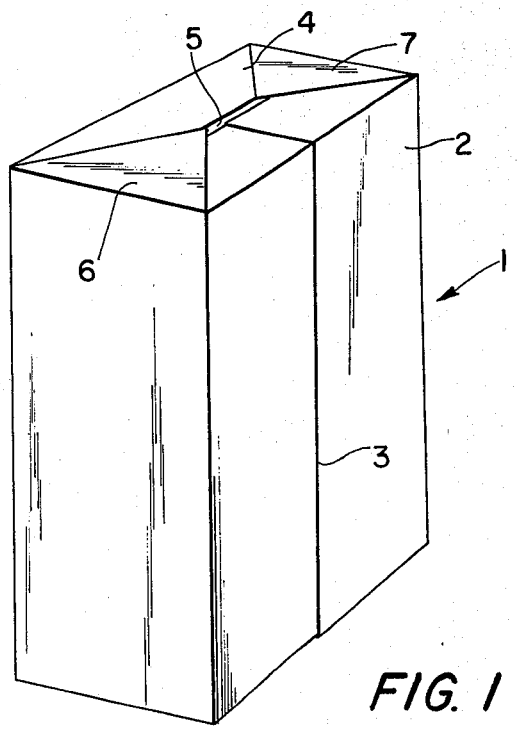

The present invention relates to a package of the type which is manufactured from a web of laminated material consisting of a base layer of paper or cardboard with a coating of thermoplastic, e.g. polyethylene on each side thereof, and wherein opposite edge portions of the web are brought together and overlapped to form a tube having a longitudinally extending joint, the tube being thereafter filled and the ends closed.

In the manufacture of packages from web material which is formed to a tube in that the longitudinal edge zones of the web are made to overlap one another so as to be sealed to one another in this position, a need exists to protect the cut edge of the material web which rests against the inside of the package from coming into contact with the contents of the package. The said protection should be designed so that it is not affected by the sterilization of the material web by means of high temperature.

The packages manufactured from a tube with overlap joint on the market at present are often designed with a strip which is applied at the sealing of the joint against the inside of the package over the area of the longitudinal joint. This strip is often designed as a loose polyethylene strip, which is fed parallel with the packing material web into the tube forming device of the packaging machine so as to be sealed to the inside of the longitudinal joint. The strip may also be designed as a fixed strip, in which case the strip is constituted of an extension of the coating material of the packing material web which often consists of a polyethylene material. When a fixed strip is used the edge zone of the material web, to which the said strip is applied, is made to rest against the inside of the package.

The said strips, which are preferably made of polyethylene and which material remains plastic at relatively low temperature, have proved unsuitable in the packaging of sterile goods. In order to retain the sterility of the contents, it is necessary, of course, to sterilize the packing material web. This sterilization takes place appropriately in such a manner that the web is brought into contact with a sterilizing liquid, e.g. hydrogen peroxide. The said liquids are often harmful and can impart to the goods contained in the package a non-desirable taste or smell and such liquids therefore have to be evaporated from the packing material. The evaporation is achieved in that air is made to circulate in the tube formed in the tube forming device. As the web moves at a relatively high speed, the time for the evaporation of the sterilization liquid is relatively short, so that the air introduced into the tube must have a very high temperature. Because of this high temperature it is necessary that the tube should be subjected to cooling through its outside, so as to prevent any of the moisture enclosed in the paper layer of the web from evaporating. This cooling is prevented, however, in the area of the longitudinal joint of the tube, owing to the edge zones of the web being made to overlap one another, as a result of which the material in the joint becomes too thick for a satisfactory cooling to be obtained in this area. The natural moisture of about 6% enclosed in the paper is thus caused to evaporate in the area of the longitudinal joint, and in particular from the edge zone which is applied against the inside of the package. Because of the said evaporation a pressure is formed underneath the strip applied over the joint. When the strip is made of polyethylene, the effect of the heated air causes it to be warmed up to its plastic temperature, which means that the vapour pressure produced underneath the strip easily deforms the strip to such an extent that it no longer fulfills its function.

The said disadvantages are overcome by the present invention which is based on the principle that a longitudinal joint of the package is covered by a strip manufactured from a laminate with a base layer material consisting of a material which has a higher softening temperature than the inner coating layer of the tube and which has small extensibility. To allow the strip to be sealed to the area of the longitudinal joint, the base layer material should also be covered with a thermoplastic material, e.g. polyethylene which has good sealing properties in respect of the said area of the longitudinal joint. The invention is characterized in that the side of the longitudinal joint of the package which faces towards the inside of the package is covered by a strip of a laminated material consisting of a base layer with higher softening temperature than the material with which the inside of the packing material web is coated and that both sides of the said base layer are coated with a material that can be sealed to the inside coating of the packing material.

The package in accordance with the present invention is manufactured preferably from a packing material web of a laminated material consisting of a base layer of paper or cardboard, which on the side which is to constitute the inside of the finished package is coated with a thermoplastic material which is preferably polyethylene. The said material web is formed to an end-closable tube in that the longitudinal edges of the web are made to overlap and are sealed to one another.

During the formation of the web to a tube, by making the edge zones of the web to overlap one another, a strip is applied to the inside of the said joint area, which is sealed to the inside coating of the packing material web. The strip should cover the edge of the packing material web which is situated against the inside of the package. In order to prevent the said strip from being softened during the heating of the packing tube at the evaporation of the sterilization liquid, it is manufactured from a laminate comprising a base layer of a material with high softening temperature. As the material in the strip, owing to the moisture of the paper being evaporated, is also subjected to a force directed towards the inside of the package, which endeavors to stretch the material in the strip, the material in the base layer of the strip must be of such a quality that it is not stretched or that the stretching remains very slight. A suitable material in the base layer of the strip is here polyamide or any foil material, e.g. aluminum foil. To allow the strip to be sealed to the inside coating of the packing material, the said base material is coated with a material that can be sealed to this coating. A suitable material for this purpose is polyethylene. The strip described can either be a loose strip or a fixed strip which is fitted to the edge zone of the material web which is applied against the inside of the tube.

Figure 2:
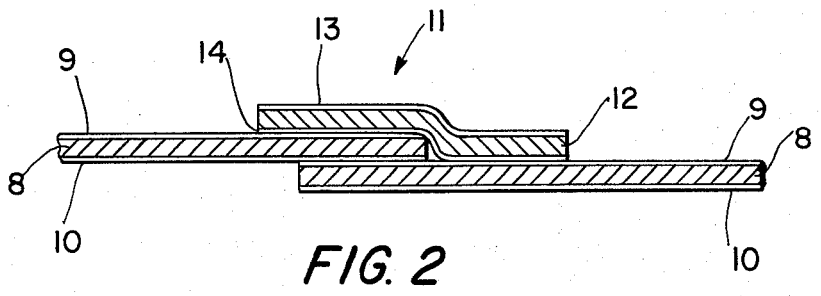

On the enclosed schematic drawing, FIG. 1 shows a package in accordance with the present invention. FIG. 2 is a section through that area of the package which contains the longitudinal joint and shows a preferred embodiment of the strip applied over the joint on the inside of the package.

In FIG. 1 a parallelepipedic package of a conventional type is indicated with the reference numeral 1.

The package is made from a tube of packaging material and the longitudinal joint of the tube can be seen on the side 2 of the package 1 and is indicated with the reference numeral 3. On the top 4 of the package there are one transversal joint 5 and two triangular lugs 6, 7, all of which have corresponding parts on the bottom of the package 1 (not shown).

In FIG. 2 is shown an enlarged section through the joint area of the package 1. As stated above, the packaging material consists of a base layer 8 of paper or cardboard, which on one or both sides is coated with a layer 9, 10 of thermoplastic material. The laminated strip according to the invention is generally indicated with 11 and consists of a base layer 12, which on both sides is coated with layers 13, 14 of a material that can be sealed to the inside layer 9 of the packaging material.

We claim:

1. In a filled package of the type which is manufactured from a material web of laminated material comprising a base layer of paper or cardboard which is coated at least on the inside with a heat-sealable polyethylene material and which material web is formed into an end closable tube in which the longitudinal edge zones of the web are heat sealed together in overlapping relation, the improvement in which the longitudinal joint on the inside of the package is covered by a strip of a laminated material consisting of a base layer of polyamide having a higher softening temperature than the polyethylene on the inside of the package, both sides of said strip base layer being coated with polyethylene, one side of which is heat sealed to the polyethylene coating on the inside of the package along the longitudinal joint.

* * * * *